US010889143B2

(12) United States Patent
Jangir

(10) Patent No.: US 10,889,143 B2
(45) Date of Patent: Jan. 12, 2021

(54) REFILLABLE WRITING INSTRUMENT

(71) Applicant: Ganesh Ram Jangir, Rajasthan (IN)

(72) Inventor: Ganesh Ram Jangir, Rajasthan (IN)

( * ) Notice: Subject to any disclaimer, the term of this patent is extended or adjusted under 35 U.S.C. 154(b) by 10 days.

(21) Appl. No.: 16/341,933

(22) PCT Filed: Aug. 24, 2017

(86) PCT No.: PCT/IB2017/055097
§ 371 (c)(1),
(2) Date: Apr. 15, 2019

(87) PCT Pub. No.: WO2018/078462
PCT Pub. Date: May 3, 2018

(65) Prior Publication Data

US 2019/0241006 A1 Aug. 8, 2019

(30) Foreign Application Priority Data

Oct. 28, 2016 (IN) ..... 201611037072

(51) Int. Cl.
*B43K 5/00* (2006.01)
*B43K 5/08* (2006.01)
(Continued)

(52) U.S. Cl.
CPC ..... *B43K 5/08* (2013.01); *B43K 5/10* (2013.01); *B43K 5/18* (2013.01); *B43K 8/03* (2013.01); *B43K 8/04* (2013.01); *B43K 11/00* (2013.01)

(58) Field of Classification Search
CPC ... B43K 5/08; B43K 5/10; B43K 5/18; B43K 8/03; B43K 8/04; B43K 11/005
(Continued)

(56) References Cited

U.S. PATENT DOCUMENTS 4,573,819 A 3/1986 Herrnring
5,362,168 A * 11/1994 Abe ..... B43K 5/1845 401/198
(Continued)

FOREIGN PATENT DOCUMENTS

EP 3025871 A1 6/2016

OTHER PUBLICATIONS

International Search Report of PCT Patent Application No. PCT/IB2017/055097 dated Oct. 31, 2017.

*Primary Examiner* — Jennifer C Chiang

(57) ABSTRACT

The present invention, in general, describes a refillable writing instrument. The writing instrument may comprise one or more master reservoir, one or more slave reservoir, one or more slave reservoir gate and one or more master reservoir gate. The slave reservoir may have reducing cross-section, facilitating fluid flow towards nib of the writing instrument. The slave reservoir gate may comprise at least one of blocking element, blocking element seat, one or more gates, one or more covers and a combination thereof. The slave reservoir gate provides a connection between the master reservoir and the slave reservoir. Further, the blocking element rests over the blocking element seat due to gravity, restricting return flow of the fluid to the master reservoir. The master reservoir gate facilitates clean, easy and fast refilling of master reservoir using fluid container or fluid nozzle without the need of opening the master reservoir cap.

14 Claims, 3 Drawing Sheets

(51) Int. Cl.

| | |
|---|---|
| ***B43K 8/03*** | (2006.01) |
| ***B43K 5/10*** | (2006.01) |
| ***B43K 5/18*** | (2006.01) |
| ***B43K 8/04*** | (2006.01) |
| ***B43K 11/00*** | (2006.01) |

(58) Field of Classification Search
USPC ..... 401/205, 206
See application file for complete search history.

(56) References Cited

U.S. PATENT DOCUMENTS

| | | | | |
|---|---|---|---|---|
| 6,086,279 | A * | 7/2000 | Yen | B43K 23/08 401/198 |
| 6,641,320 | B1 * | 11/2003 | Ballot | A45D 34/042 401/198 |
| 2006/0182489 | A1 | 8/2006 | Kobayashi | |

* cited by examiner

REFILLABLE WRITING INSTRUMENT

CROSS-REFERENCE TO RELATED APPLICATIONS AND PRIORITY

The present application does claim priority from an Indian patent application number 201611037072 dated 28 Oct. 2016.

TECHNICAL FIELD

The present disclosure in general, relates to field of writing instruments. More particularly, the disclosure relates to a refillable writing instrument that works in different writing positions even when nib is inclined upwards, having a mechanical means for easy refilling of the writing instrument.

BACKGROUND

Pens are considered as a convenient option for writing. There are many types of pens such as fountain pen, ball pen, marker pen, highlighter, etc. that are used are per their utility over the application. Marker pens are used for writing over boards generally for teaching/meeting purposes. Many a times it is observed that the marker pen doesn't write properly over the board mounted on vertical wall. The improper writing of a marker pen is a common phenomenon while writing over the board placed on the vertical wall. This occurs when the marker is in tilted position (nib upwards), wherein ink inside the marker flows away from the nib of the marker due to gravity. Periodically, the marker is refilled by ink based on its use and the refilling of the marker is troublesome and time consuming. The troublesome refilling of the marker may spill the ink around and make stains in surrounding objects.

The nib doesn't get enough supply of the ink, resulting in drying of channel from ink reservoir to the nib of the marker. The drying of the channel also shortens the life span of the marker. It is observed that that marker stops working frequently and user of the marker has to position the marker such that nib is downward in order to reach the ink to the nib. Sometimes, the user also has to shake the marker in order to reach the ink to the nib. There is a need in order to provide an alternative to the smooth and continuous flow of ink towards the nib of the marker irrespective of the writing position. Additionally, when the ink inside the marker is fully utilised, refilling of the ink is done. But refilling of the marker pen is troublesome task. Many times, the ink spreads around and spills sometimes during the refilling of the marker.

SUMMARY

Before the present instrument and its components are described, it is to be understood that this disclosure is not limited to the particular instrument and its arrangement as described, as there can be multiple possible embodiments which are not expressly illustrated in the present disclosure. It is also to be understood that the terminology used in the description is for the purpose of describing the particular versions or embodiments only, and is not intended to limit the scope of the present application. This summary is not intended to identify essential features of the claimed subject matter nor is it intended for use in detecting or limiting the scope of the claimed subject matter.

In one embodiment, a writing instrument is described. The writing instrument may comprise one or more slave reservoir, one or more master reservoir; one or more slave reservoir gate and one or more master reservoir gate. The one or more slave reservoir may have a reducing cross-sectional area that facilitates fluid flow towards nib. The one or more slave reservoir gate may comprise at least one of one or more blocking element, one or more blocking element seat, one or more gates, one or more covers and a combination thereof. The one or more slave reservoir gate may provide a connection between the one or more master reservoir and the one or more slave reservoir. The one or more covers may displace within the one or more guide cover when the one or more slave reservoir is filled with a predefined level of fluid. The displacement of the one or more covers may stop the fluid supply to the one or more slave reservoir. The one or more blocking element may rest over the one or more blocking element seat thereby restricting return flow of the fluid to the one or more master reservoir, from the one or more slave reservoir to the one or more master reservoir.

In another embodiment, a method of supplying fluid to nib of the writing instrument is described. The method may provide, via one or more slave reservoir gate, connecting means between master reservoir and slave reservoir. The one or more slave reservoir gate may comprise at least one of one or more blocking element, one or more blocking element seat, one or more cover, one or more master reservoir gate, one or more reservoir gate and a combination thereof. The method may allow, via the one or more slave reservoir gate, fluid to pass from the one or more master reservoir to the one or more slave reservoir. The method may displace, the one or more covers within one or more guide cover when the one or more slave reservoir is filled with a predefined level of fluid. The method may restrict, via the one or more slave reservoir gate, return flow of the fluid to the one or more master reservoir. The one or more blocking element may rest over the one or more blocking element seat within the one or more cover of the one or more slave reservoir gate.

BRIEF DESCRIPTION OF THE DRAWINGS

The detailed description is described with reference to the accompanying Figures. In the Figures, the left-most digit(s) of a reference number identifies the Figure in which the reference number first appears. The same numbers are used throughout the drawings to refer like features and components.

DETAILED DESCRIPTION

Some embodiments of this invention, illustrating all its features, will now be discussed in detail.

The words "comprising," "having," "containing," and "including," and other forms thereof, are intended to be equivalent in meaning and be open ended in that an item or items following any one of these words is not meant to be an exhaustive listing of such item or items, or meant to be limited to only the listed item or items.

It must also be noted that as used herein and in the appended claims, the singular forms "a," "an," and "the" include plural references unless the context clearly dictates otherwise. Although any systems and methods similar or equivalent to those described herein can be used in the practice or testing of embodiments of the present invention, the preferred, systems and methods are now described. The disclosed embodiments are merely exemplary of the invention, which may be embodied in various forms.

Various modifications to the embodiment will be readily apparent to those skilled in the art and the generic principles herein may be applied to other embodiments. However, one of ordinary skill in the art will readily recognize that the present disclosure is not intended to be limited to the embodiments illustrated, but is to be accorded the widest scope consistent with the principles and features described herein.

Figure 1A:
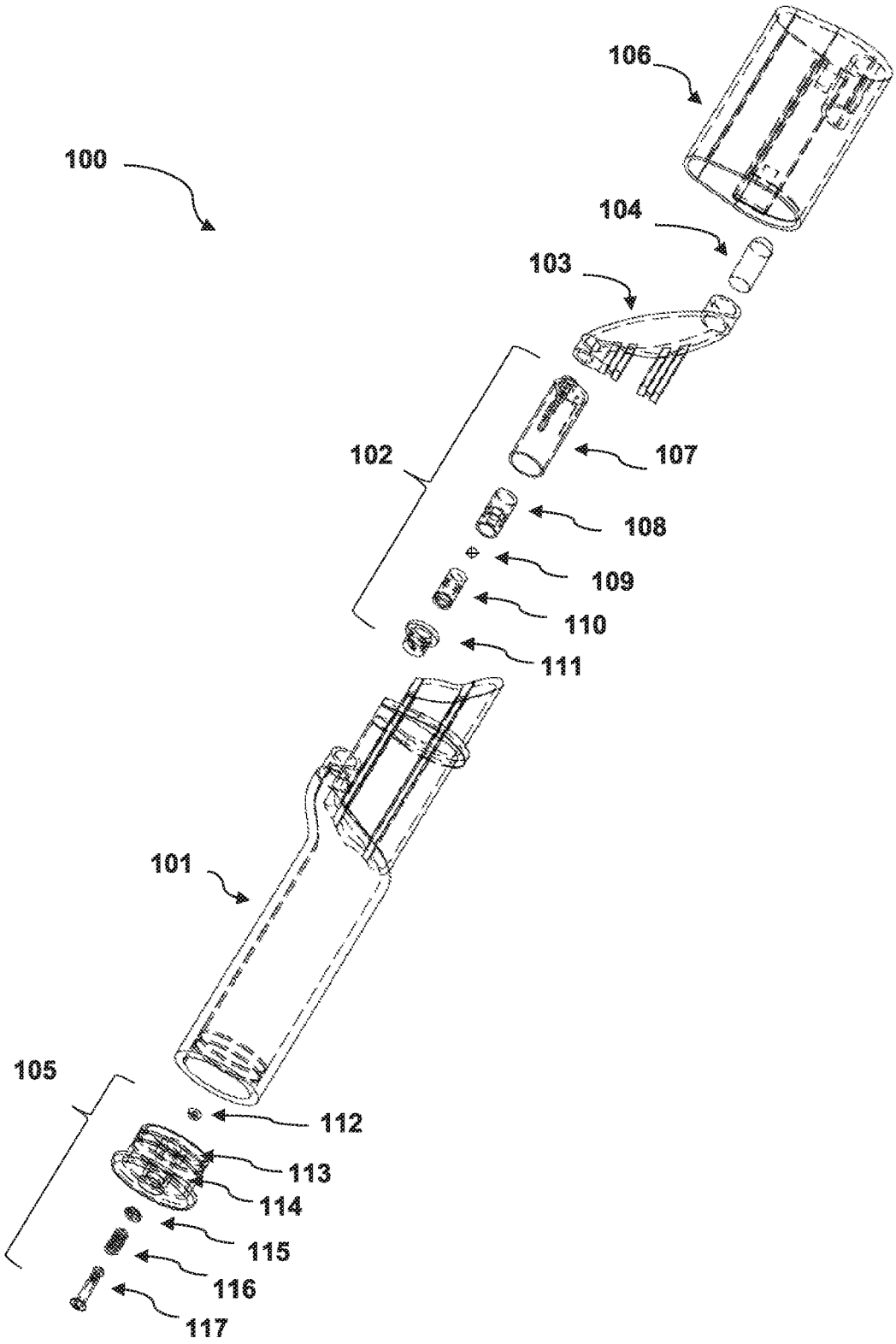
FIG. 1*a* illustrates an exploded view of self-refillable writing instrument 100, in accordance with an embodiment of the present disclosure.
Figure 1B:
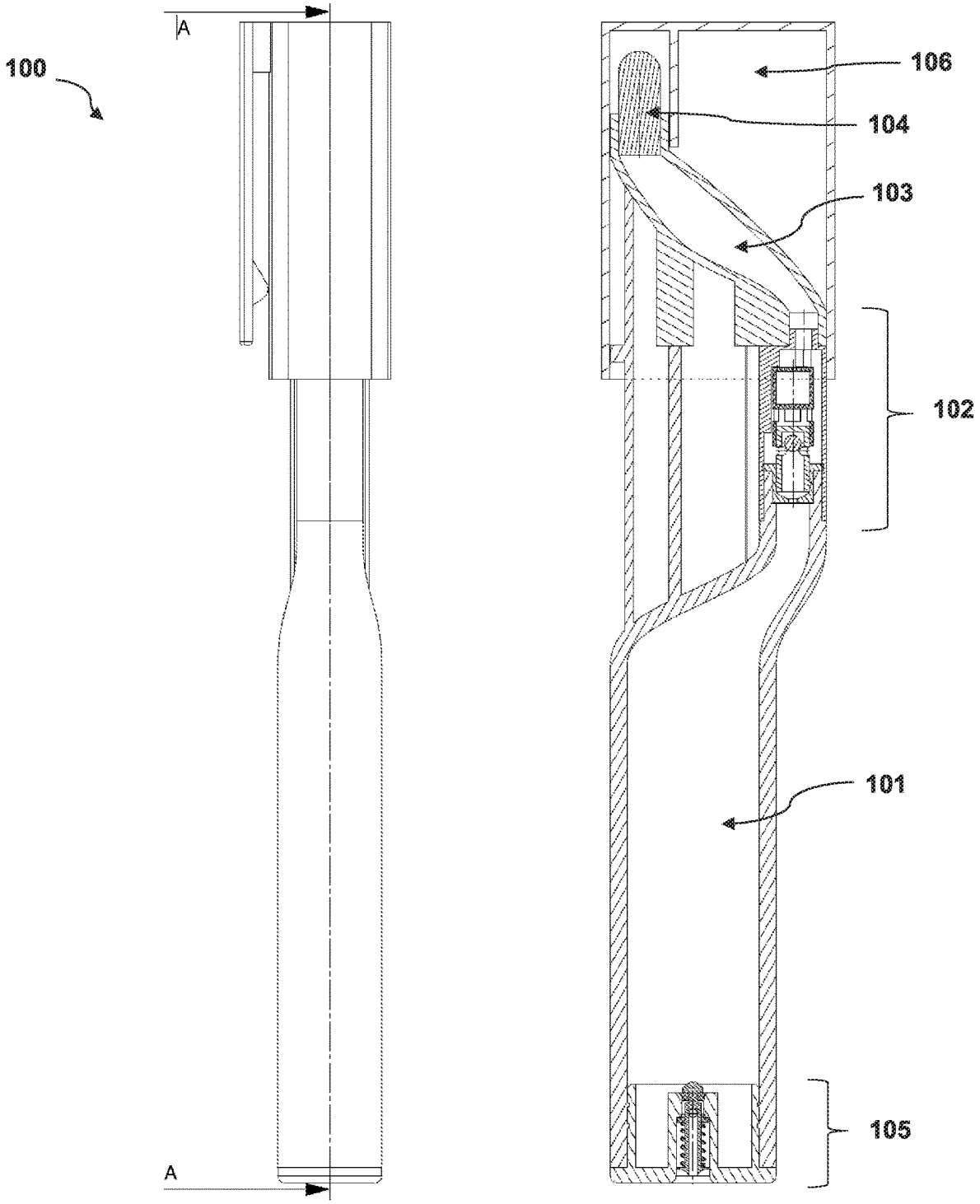
FIG. 1*b* illustrates an assembled cross-sectional view refillable writing instrument 100, in accordance with an embodiment of the present disclosure

FIGS. 1*a* and 1*b* illustrates a refillable writing instrument 100 in accordance with an embodiment of the present disclosure. FIG. 1*a* illustrates an exploded view and FIG. 1*b* illustrates an assembled cross-sectional view of the writing instrument 100 respectively. The writing instrument 100 may be marker pen, highlighter, fountain pen and the like. The writing instrument 100 may comprise one or more master reservoir 101, one or more slave reservoir 103, one or more slave reservoir gate 102 and one or more master reservoir gate 105. The one or more slave reservoir gate 102 may facilitate supply of fluid from the one or more master reservoir 101 to the one or more slave reservoir 103. The one or more slave reservoir 103 may be of reducing cross-section, facilitating fluid flow towards nib during different positions of writing instrument 100. The one or more slave reservoir 103 may further have an inclined cross-section, facilitating the flow of fluid towards the nib 104 of the writing instrument 100. The fluid in the writing instrument 100 may be ink, writing fluid, gel and the like. A reservoir cap 114 having the one or more master reservoir gate 105 may be incorporated, to the one or more master reservoir 101, to facilitate easy refilling of the one or more master reservoir 101 present in the writing instrument 100.

Figure 2:
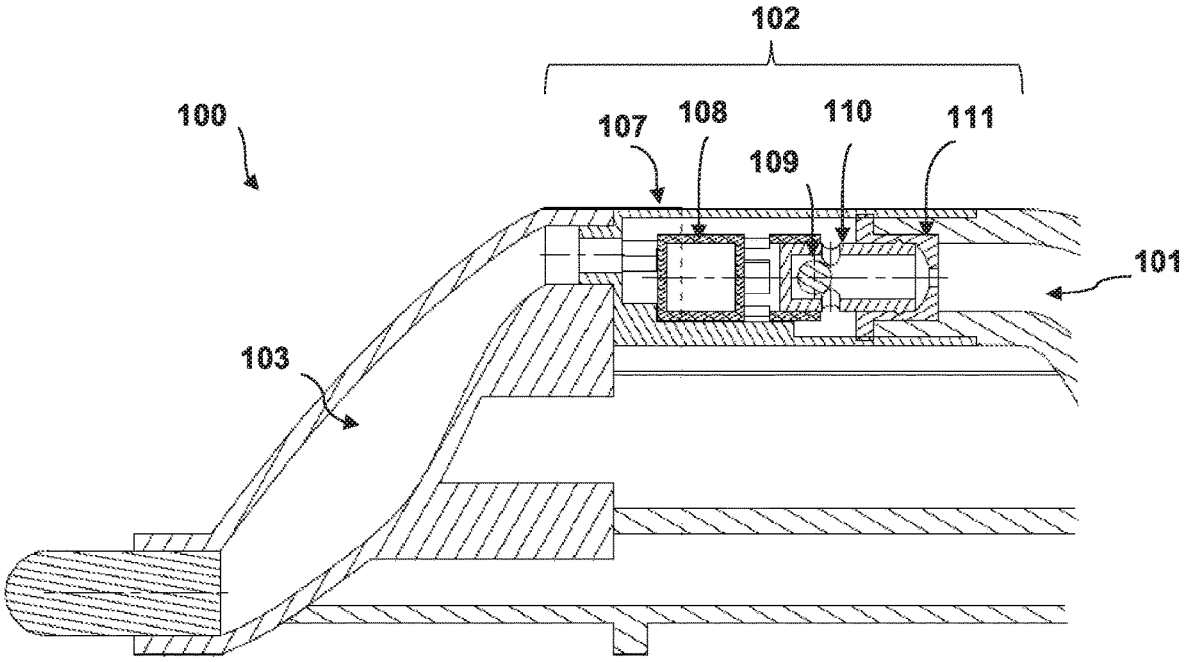
FIG. 2 illustrates a slave reservoir gate 102 of the refillable writing instrument 100, in accordance with an embodiment of the present disclosure.

FIG. 2 illustrates the slave reservoir gate 102 present within the refillable writing instrument 100, in accordance with an embodiment of the present disclosure. Referring FIG. 2, the slave reservoir gate 102 may comprise at least one of one or more blocking element 109, one or more blocking element seat 111, one or more gates 110, one or more cover (107,108) and a combination thereof. When the writing instrument 100 is pointing downwards for writing purpose, the fluid or writing fluid passes through the one or more slave reservoir gate 102 towards the one or more slave reservoir 103 due to gravity. The one or more gates 110 may facilitate the fluid or writing fluid supply to the one or more slave reservoir. When the one or more slave reservoir 103 is filled up to a predefined level, the fluid or writing fluid which is present the one or more slave reservoir gate 102 may displace the one or more cover 108 within the one or more guide cover 107. The displacement of one or more covers 108 thereby may stop the fluid or writing fluid supply to flow towards the one or more slave reservoir 103. The fluid or writing fluid present in the one or more slave reservoir gate 102 may allow the one or more cover 108 to float, enabling the displacement of the cover 108 within the one or more guide cover 107. Guiding means may be provided for the displacement of the one or more covers 108 may be in a predefined direction. The blocking element 109 may rest on the one or more blocking element seat 111 inside slave reservoir gate 102 and may further restrict the return flow of the fluid or writing fluid towards the one or more master reservoir 101 when writing instrument 100 is pointed or inclined upwards. The writing instrument 100 may further be used for uninterrupted writing on vertical board wherein the writing instrument 100 may be in inclined position (nib in upward or inclined direction) with respect to the one or more master reservoir 101. The filled slave reservoir 103 enables a continuous and appropriate supply of the fluid or writing fluid towards the nib 104. The continuous supply of the fluid or writing fluid may facilitate uninterrupted writing. A cap 106 may be used to cover and protect the nib when the writing instrument 100 is not in use. Porous or fibrous materials may be additionally inserted within the one or more slave reservoir 103 and the one or more master reservoir 101 in order to facilitate the storage and flow of the fluid or writing fluid.

When the writing instrument 100 may be in inclined position (the nib in upward direction) with respect to the one or more master reservoir 101, the one or more blocking element 109 may rest over the one or more blocking element seat, restricting return flow of the fluid or writing fluid to the one or more master reservoir 101. The resting of the one or more blocking element 109 over the one or more blocking element seat 111 may be due to gravity. There may be different shape of the one or more blocking element 109 for example spherical, tubular, round, elliptical, cylindrical or parallelepiped. The one or more blocking element 109 may be made of solid material and may have density higher than the fluid or the writing fluid. The one or more blocking element 109 may be made of metal, plastic, polymer or any other material.

The floating of the one or more covers 108 may allow continuous flow to the one or more slave reservoir 103 until the fluid or writing fluid is present within the one or more slave reservoir gate 102. The fluid present in the one or more slave reservoir gate 102 may be further transferred to the one or more slave reservoir 103 as per consumption of fluid present inside the one or more salve reservoir 103. The one or more covers 108 may settle, via the guiding means, within the one or more guide cover 107. When the fluid or writing fluid level in the one or more slave reservoir 103 is below the predefined level, the one or more gates 110 may further allow the fluid or writing fluid to pass from the one or more master reservoir 101 to the one or more slave reservoir 103. The said process may run dynamically. Thus, the one or more salve reservoir gate 102 may enable and control the refilling of the slave reservoir 103 in order to ensure appropriate supply of fluid to the nib 104 in different positions of the writing instrument 100.

Figure 3:
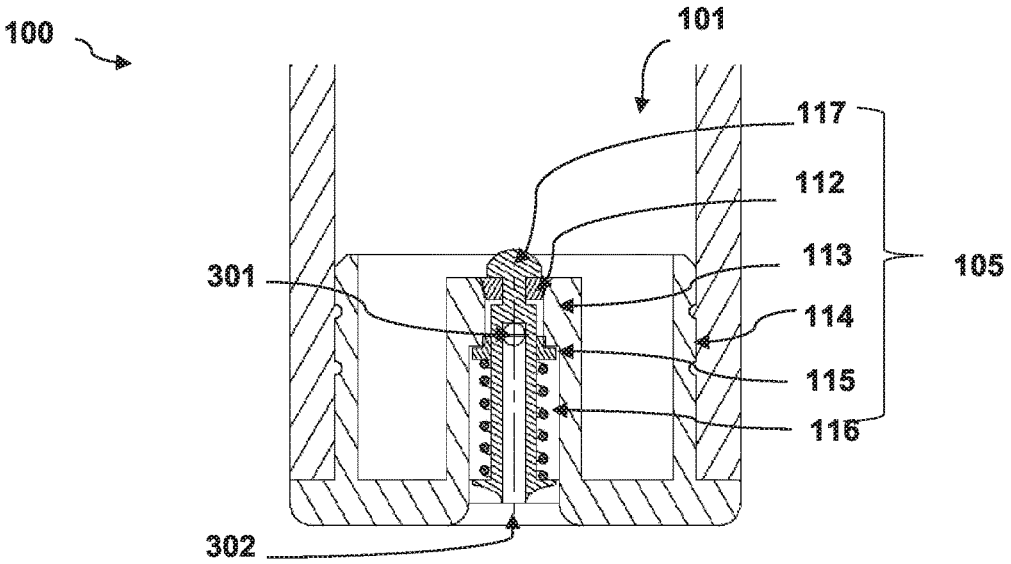
FIG. 3 illustrates a master reservoir gate 105 of the refillable writing instrument 100, in accordance with an embodiment of the present disclosure.

FIG. 3 illustrate the one or more master reservoir gate 105 of the refillable writing instrument 100, in accordance with an embodiment of the present disclosure. Referring FIG. 3, the one or more master reservoir gate 105 may comprise of at least one or more block element 117, one or more block element seat 113, one or more resilient means 116 and a combination thereof. In order to refill the fluid or writing fluid in the master reservoir 101, the fluid container tip or nozzle may be placed at refilling point 302. The one or more block element 117 may get displaced from the one or more block element seat 113 due to pressure or force of fluid container nozzle or fluid itself, thus opening passage to the one or more master reservoir 101 for the fluid or writing fluid. When fluid container tip or nozzle is removed, the one or more resilient means 116 may move the one or more block element 117 onto the one or more block element seat 113. The one or more block element 117 may further block the passage of the fluid. The blocking may enable restricting, in both direction, the fluid or writing fluid to or from the one or more master reservoir 101. The one or more seal element 112,115 may help in preventing any leakage of fluid or writing fluid. An opening 301 on the one or more block element 117 may enable the fluid or writing fluid to flow directly into the one or more master reservoir 101. The one or more master reservoir gate 105 may be located at reservoir cap 114 or any other suitable location.

In another embodiment, a method of supplying fluid to the nib 104 of a writing instrument 100 is described. The method may comprise the one or more slave reservoir gate 102, wherein the one or more slave reservoir gate 102 may act as connecting means between the one or more master reservoir 101 and the one or more slave reservoir 103. The one or more slave reservoir gate 102 may comprise at least one of the one or more blocking element 109, the one or more blocking element seat 111, the one or more gates 110, the one or more covers (107,108) and a combination thereof. The method may further allow, via the one or more slave reservoir gate 102, the fluid or writing fluid to pass from the one or more master reservoir 101 to the one or more slave reservoir 103, wherein the one or more cover 108 may be displaced within the one or more guide cover 107 of the one or more slave reservoir gate 102. The method may further fill the one or more slave reservoir 103 to a predefined level and may stop the fluid or writing fluid supply, via the one or more slave reservoir gate 102, to the one or more slave reservoir 103. The method may further comprise supply of the fluid or writing fluid to the one or more slave reservoir 103 when the fluid or writing fluid level is less than the predefined level. The method may restrict, via the one or more slave reservoir gate 102, the return flow of the fluid or writing fluid to the one or more slave reservoir 103, wherein the one or more blocking element 109 rests over the one or more blocking element seat 111 present within the one or more guide cover 107 of the one or more slave reservoir gate 102.

In another embodiment, the method of refilling the one or more master reservoir 101 or the one or more slave reservoir 103 is described. The one or more slave reservoir gate 105 may comprise of at least one or more block element 117, one or more block element seat 113 and one or more resilient means 116 enabling refilling of fluid without opening or disassembling the writing instrument. The respective gate may open due to pressure of fluid or fluid container nozzle and the one or more block element 117 may block the fluid passage due to recoiling action of the one or more resilient mean 116 when the nozzle of fluid container is removed from refilling point 302.

The embodiments, methods, examples and alternatives of the preceding paragraphs or the description and drawings, including any of their various aspects or respective individual features, may be taken independently or in any combination. Features described in connection with one embodiment are applicable to all embodiments, unless such features are incompatible.

I claim:

1. A writing instrument (100) comprising:

one or more slave reservoir (103), having a reducing cross-sectional area facilitating fluid flow towards nib;

one or more master reservoir (101);

one or more slave reservoir gate (102) comprising at least one of one or more blocking element (109), one or more blocking element seat (111), one or more gates (110), one or more covers (107, 108) and a combination thereof, wherein the one or more slave reservoir gate (102) provides a connection between the one or more master reservoir (101) and the one or more slave reservoir (103);

wherein displacement of the one or more covers (108) within a guide cover (107) when the one or more slave reservoir (103) is filled with a predefined level of fluid;

wherein the displacement of the one or more covers (107) stop the fluid supply to the one or more slave reservoir (103);

wherein the one or more blocking element (109) rests over the one or more blocking element seat (111) thereby restricting return flow of the fluid to the one or more master reservoir (101), from the one or more slave reservoir (103) to the one or more master reservoir (101).

2. The writing instrument of claim 1 further comprises one or more master reservoir gate (105), wherein the one or more master reservoir gate comprises of at least one of one or more block element (117), one or more block element seat (113), one or more resilient means (116) and a combination thereof, wherein the one or more master reservoir gate (105) facilitates the refilling of one or more master reservoir (101).

3. The writing instrument of claim 1, wherein the one or more slave reservoir (103) further comprises a slant or an inclined cross-section, facilitating the fluid flow towards the nib (104).

4. The writing instrument of claim 1, wherein the one or more covers (108) enables and controls the supply of fluid to the one or more slave reservoir (103) and maintain fluid pressure within the one or more slave reservoir (103).

5. The writing instrument of claim 1, wherein the one or more covers (108) floats with help of the fluid present in the one or more slave reservoir gate (102).

6. The writing instrument of claim 1, wherein the one or more blocking element (109) prevents the return flow of fluid from the one or more slave reservoir (103) to the one or more master reservoir (101).

7. The writing instrument of claim 1 further comprises guiding means for the one or more covers (108), wherein the guiding means provide displacement of the one or more covers (108) in a predefined direction.

8. The writing instrument of claim 1, wherein porous or fibrous material is used within the one or more slave reservoir (103) and the one or more master reservoir (101) facilitating the storage and flow of the fluid.

9. The writing instrument of claim 1, wherein shape of the one or more blocking element (109, 117) is spherical, elliptical, tubular, round or parallelepiped.

10. The writing instrument of claim 1, wherein the one or more blocking element (109,117) is made of solid material, having density higher than the fluid.

11. The writing instrument of claim 1, wherein the fluid is at least one of ink, writing fluid and gel.

12. The writing instrument of claim 1, wherein the one or more master reservoir gate (105) opens the way to the one or more master reservoir (101), facilitating the refilling of the one or more master reservoir (101) from a fluid container or a fluid container nozzle and further blocking the way of the fluid when the fluid container or the fluid container nozzle is removed.

13. A method of supplying fluid to nib (104) of a writing instrument (100), the method comprising:

providing, via one or more slave reservoir gate (102), connecting means between one or more master reservoir (101) and one or more slave reservoir (103), wherein the one or more slave reservoir gate (102) comprises at least one of one or more blocking element (109), one or more blocking element seat (111), one or more covers (107,108), one or more gates (110) and a combination thereof;

allowing, via the one or more slave reservoir gate (102), fluid to pass from the one or more master reservoir (101) to the one or more slave reservoir (103), displacing, the one or more covers (108) within one or more guide cover (107) when the one or more slave reservoir (103) is filled with a predefined level of fluid;

restricting, via the one or more slave reservoir gate (102), return flow of the fluid to the one or more master reservoir (101), wherein the one or more blocking element (109) rests over the one or more blocking element seat (111) within the one or more cover (108) of the one or more slave reservoir gate.

14. The method of claim 13 further facilitates, via the one or more master reservoir gate (105), refilling of the one or more master reservoir (101).

* * * * *